United States Patent [19]

Nakamura et al.

[11] Patent Number: 4,621,993

[45] Date of Patent: Nov. 11, 1986

[54] SCROLL-TYPE POSITIVE FLUID DISPLACEMENT APPARATUS WITH OIL COMPARTMENT PLATE

[75] Inventors: Toshiyuki Nakamura; Masahiro Sugihara; Tsutomu Inaba; Tadashi Kimura, all of Wakayama, Japan

[73] Assignee: Mitsubishi Denki Kabushiki Kaisha, Tokyo, Japan

[21] Appl. No.: 700,227

[22] Filed: Feb. 11, 1985

[30] Foreign Application Priority Data

Feb. 10, 1984 [JP] Japan ..... 59-23280

[51] Int. Cl.[4] ..... F01C 1/04; F01C 21/04; F01M 1/02; F01M 11/00

[52] U.S. Cl. ..... 418/55; 418/88; 418/94; 184/6.18; 184/6.23; 62/469

[58] Field of Search ..... 418/55, 88, 94; 417/902; 184/6.16, 6.18, 6.23; 62/469

[56] References Cited

U.S. PATENT DOCUMENTS 2,239,723 4/1941 Limpert et al. ..... 417/902
3,066,857 12/1962 McCloy ..... 417/902
4,488,855 12/1984 Butterworth et al. ..... 418/55

*Primary Examiner*—John J. Vrablik
*Attorney, Agent, or Firm*—Sughrue, Mion, Zinn, Macpeak, and Seas

[57] ABSTRACT

A scroll-type pumping apparatus comprising a stationary scroll 1, an orbiting scroll 2 and a drive shaft 6 driving the orbiting scroll. A bottom end portion of the drive shaft is dipped in oil in a basin 150 formed at the bottom side of the apparatus. A compartment plate 30 is arranged between the basin and a motor 10 and 11 driving the drive shaft. Flow preventing means allows flow only in the direction from an upper side to a lower side of the compartment plate.

4 Claims, 11 Drawing Figures

FIG. 5
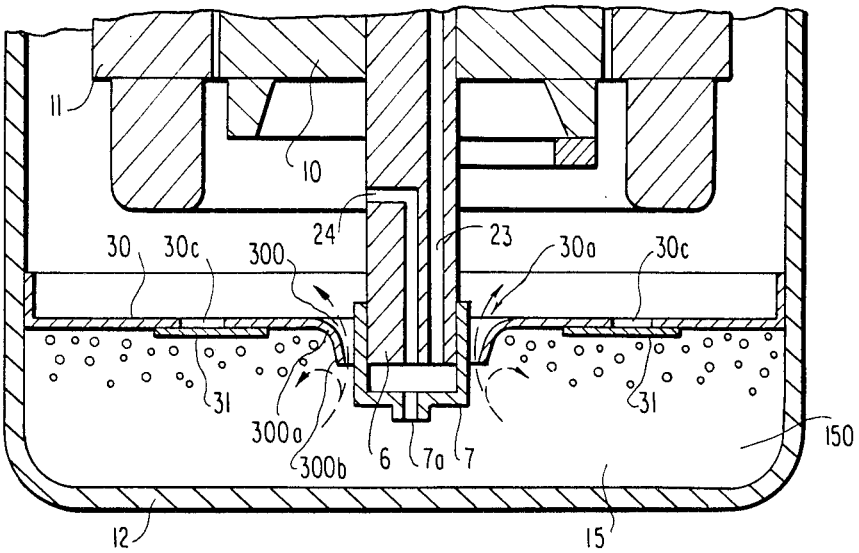
FIG. 6
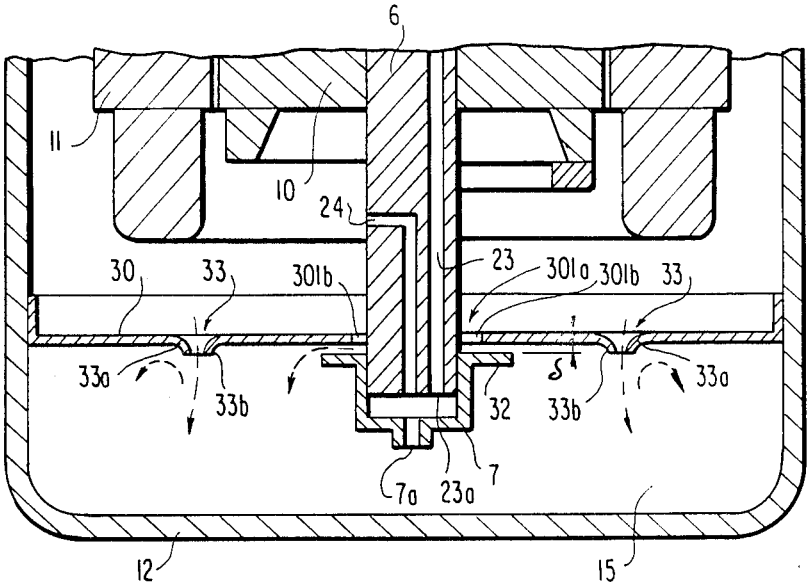
FIG. 7
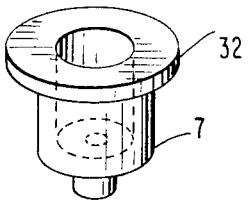
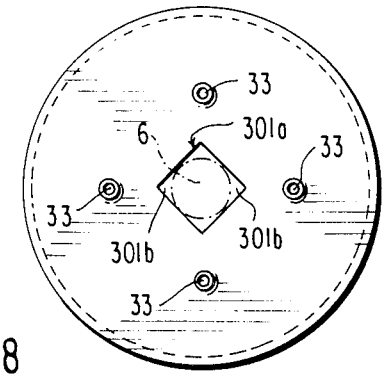
FIG. 8

SCROLL-TYPE POSITIVE FLUID DISPLACEMENT APPARATUS WITH OIL COMPARTMENT PLATE

BACKGROUND OF THE INVENTION

This invention relates to a scroll-type positive fluid displacement apparatus for compressing, expanding or pumping fluids.

The principles of operation of a scroll apparatus for compressing will be explained with reference to FIG. 1, which shows a stationary involute or spiral-shaped scroll 1 and an orbiting scroll 2 of like shape but displaced and rotated by 180°. The two scrolls 1 and 2 are composed of respective wraps 1*a* and 2*a*, each of the same spiral shape but rotated about 180° with respect to each other. The orbiting scroll 2 performs orbital motion about a point without rotation. Thus, a side of the orbiting scroll moves so as to always remain in a parallel position. As shown in the sequence of FIG. 1, compression pockets 5 are formed in the space between the stationary and orbiting scroll members 1 and 2. As the orbiting scroll 2 orbits about a central point 0, the volumes of the pockets 5 are decreased in this compressing operation until they merge into a single, similarly shrinking central outlet pocket 4'. Further compression of the central outlet pocket 4' forces the fluid out a port 4. At the same time, new inlet pockets are formed as shown in FIG. 1(*c*) at 3, 5, which progressively shrink or are compressed.

In FIG. 2 showing a conventional hermetic type refrigerant compressor using a scroll pump. The orbiting scroll member 2 is supported by a first thrust bearing 21 formed on a support member 8. A pin 2*b* mounted at the center of the orbiting scroll member 2 is engaged with a drive shaft 6 through an inner bearing 18 such that the orbiting scroll member 2 is being engaged with the stationary scroll member 1. The inner bearing 18 is disposed within a hole formed eccentrically with a generally tubular wall 6*a* at the top of the drive shaft 6. An outer bearing 19 provides a slideable engagement between the drive shaft 6 and the support member 8. The drive shaft 6 is supported with a first thrust bearing 21 and a second thrust bearing 22 which are formed in the support members 8 and 9. The support member 8 is rigidly attached to an outer cylindrical portion 801 that is positioned around an inner cylindrical space 901. An Oldham coupling 13 is mounted between the orbiting scroll member 2 and the support member 8. The Oldham coupling 13 is a well-known mechanism for inducing orbital motion while preventing rotation. The stationary scroll member 1 is fixed to the supporting members 8 and 9 by fixing means like bolts. A rotor 10 of a motor and an oil cap 7 are fixed to the drive shaft 6, and a stator 11 of the motor is fixed to the supporting member 9, all by means of shrinkage fits, screws or heavy force fits. All parts of the scroll compressor mentioned above are mounted in a shell 12, in an arrangement that the stationary and orbiting scroll members 1 and 2 are positioned above the rotor 10 and the stator 11.

In the construction shown in FIG. 2, when the rotor 10 is rotated, it operates through the Oldham coupling 13 and the drive shaft 6 to cause the orbiting scroll member 2 to move in the orbiting motion such as shown in FIG. 1. When a gaseous fluid is introduced from an inlet tube 16 into the shell 12 during compression operation, the gaseous fluid cools the motor when it passes through a passage 27 formed between the supporting member 9 and the stator 11 and also through a gap formed between the rotor 10 and the stator 11. A gaseous fluid taken up into a compression pocket 5 from an inlet pocket 3 is compressed, and exhausted from an outlet 17 through the outlet port 4. A lubricating oil 15 is fed to the bearings 18 an 20 by centrifugal pumping operation due to the action of the rotating oil cap 7 and an oil hole 23 in the drive shaft 6. Furthermore the lubricating oil which has been fed to the inner bearing 18 is also supplied to the outer bearing 19 and the thrust bearings 21 and 22. The oil used in lubricating is then returned to an oil basin 150 through oil passages 25 and 26. A baffle plate 14 is shaped like a ring, and is fixed in a groove formed on the inside of the supporting member 8 to separate the side of the inlet pocket 3 from the other side of the sliding mechanism in order to prevent the oil, leaking out from the thrust bearing 21, from splashing directly into the inlet pocket 3. A vent hole 24 is formed in the drive shaft 6 so that any gas brought in to the oil cap 7 is exhausted out of the oil cap 7 with the result that the pumping efficiency is kept high during the pumping operation.

The conventional scroll compressor, described above, suffers from the problem that the compressor may be emptied of lubricating oil. This emptying process is caused by foaming produced when liquid refrigerant flows from an evaporator into the oil in the oil basin 150, or when the liquid refrigerant dissolved in the oil during long inactive periods of the scroll compressor is drawn into the scroll compressor upon starting.

As the result of the poor lubrication, the bearings 18, 19, 20, 21 and 22 are likely to be damaged or to seize.

SUMMARY OF THE INVENTION

An object of the present invention is to provide an improved scroll-type positive fluid displacement apparatus which is able to restrain lubricating oil from foaming and from being emptied out of the compressor.

The object is accomplished by providing an improved scroll-type positive fluid displacement apparatus comprising a stationary scroll member having a spiral-shaped wrap, an orbiting scroll member having a spiral-shaped wrap of the same shape as that of the spiral wrap of the stationary scroll member but having a rotated orientation, a compression pocket formed by a space between the wraps of the stationary scroll member and the orbiting scroll member, a drive shaft having an eccentric hole formed at its upper end with a predetermined eccentricity, causing the orbiting scroll member to orbit, a bearing mounted in the hole for radially supporting the drive shaft, a supporting member for supporting the bearing, a motor for rotating the drive shaft, a shell, a bottom portion of which forms a basin for a pool of oil into which a lower end of the drive shaft is dipped. The apparatus contains the stationary and orbiting scroll members on its upper side and the motor on its lower side. A pumping member has a hole opening at the lower end of the drive shaft, formed in the axial direction of the drive shaft and supplying lubricant to the bearing by the rotational action of the driving shaft. A compartment plate has a center hole to receive an end of the drive shaft and maintains a gap for the drive shaft. Flow prevention means allows flow only from an upper side to a lower side of the plate.

BRIEF DESCRIPTION OF THE DRAWINGS

FIG. 5 is partially enlarged longitudinal sectional view of FIG. 3.

FIG. 6 is a partially enlarged longitudinal sectional view of another compressor in accordance with this invention.

FIG. 7 is a perspective view of an oil cap.

FIG. 8 is a bottom plan view of a compartment plate for the embodiment of FIG. 6.

DETAILED DESCRIPTION OF THE PREFERRED EMBODIMENTS

Figure 1:
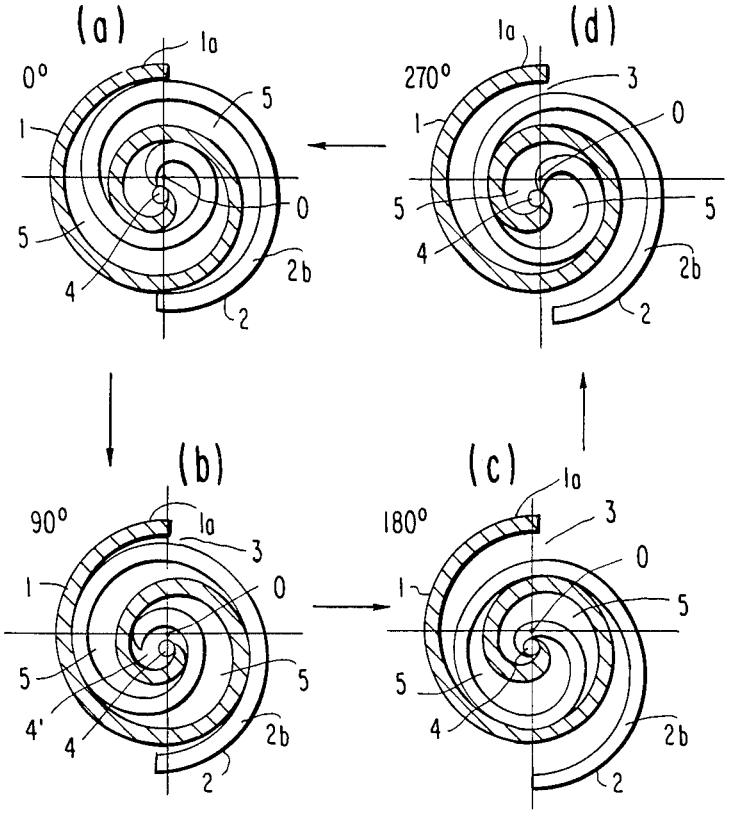
FIG. 1 contains diagrams (a), (b), (c) and (d) explaining the principles of operation of a scroll pump.
Figure 2:
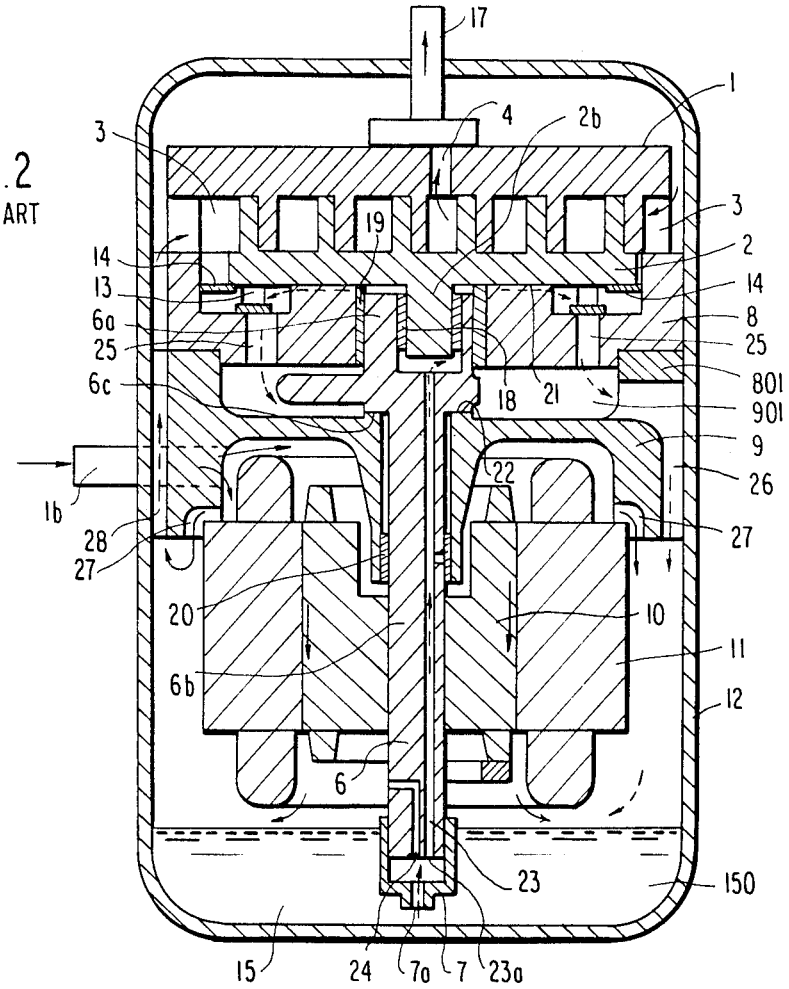
FIG. 2 PRIOR ART
FIG. 2 is a longitudinal sectional view of a conventional hermetic-type refrigerant compressor.
Figure 3:
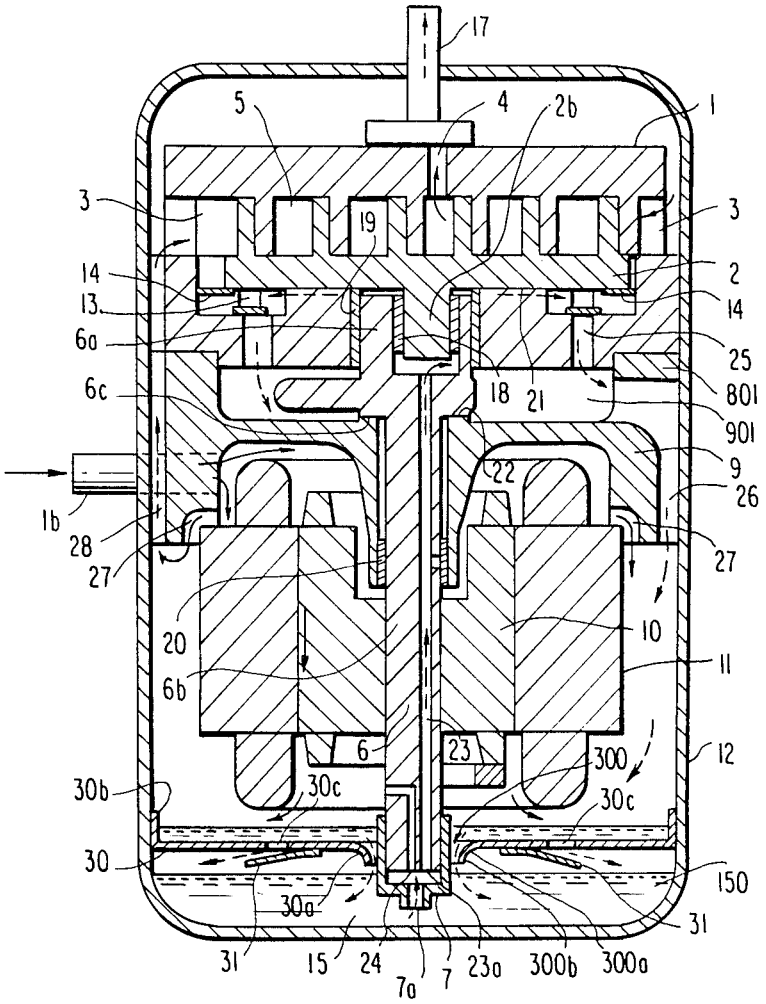
FIG. 3 is a longitudinal sectional view of a hermetic type refrigerant compressor in accordance with this invention.

FIG. 3 shows one embodiment of the present invention, wherein the same or the like parts are shown in FIG. 3 by the corresponding reference numerals of FIGS. 1 and 2.

Figure 4:
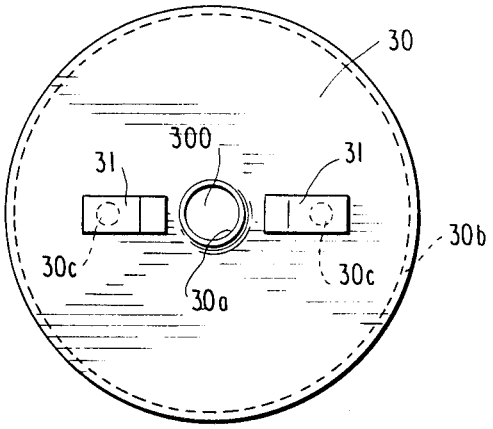
FIG. 4 is a bottom plan view of a compartment plate.

The basin 150 is covered by a compartment plate 30 located about the lower part of the drive shaft 6 and formed of sheet metal. The compartment plate 30 has a cylindrical hole 300 for accommodating the driving shaft 6 passing through at the center of the compartment plate 30. The cylindrical hole 300 is formed by a projection part 30*a* and is made narrower from a base part 300*a* toward a bottom end 300*b*, as shown in FIG. 5. As a result, flow resistance is increased toward the bottom end 300*b* of the projection 30*a*. The plate 30 has a flange 30*b* around a periphery of the plate 30, used to spot weld the plate 30 onto the inner surface of the shell 12. Furthermore, as shown in FIG. 4, the plate 30 has a hole 30*c* for returning the oil to the basin 15Q via a non-return valve 31 attached on the lower side of the plate 30 by spot welding. The non-return valve 31 is formed by bending a thin metal plate.

In the construction shown in FIGS. 3, 4 and 5, a broken line arrow shows the direction of the flow of lubricating oil 15, and a full line arrow the direction of the flow of the gas. The lubricating oil 15 flows from the hole 7*a* in the cap 7 to the passage 26 in the same direction as the flow in FIG. 2. The oil 15 exhausted from the passage 26 is temporarily gathered on the plate 30. When the height of the gathered oil reaches some limiting height, the non-return valve 31 is opened by the pressure head of the gathered oil and the oil is returned to the basin 150 through the holes 30*c* and 30*a*. The flow resistance of the holes 30*c* and 30*a* is predetermined in consideration of the desired balance of the quantity of returned and pumped oil which is maintained by keeping the appropriate quantity of oil on the plate 30. When the foaming, previously described, occurs as shown in FIG. 5 at the time of starting, the hole 30*c* is closed by the non-return valve 31 by the action that a free end of the non-return valve 31 is forced against the hole 30*c* by the pressure of the foaming. The reverse or upward flow of the oil through the hole 30*c* is inhibited by the non-return valve 31. In regard to the flow through the cylindrical hole 300, the resistance of the flow from the lower side of the plate 30 to the upper side of the plate 30 is greater than that in the reverse direction so that the reverse flow of oil through the cylindrical hole 300 is greatly inhibited.

As described above, the compartment plate 30 has the function of restraining the reverse flow of the oil and to cause the inner pressure in a space beneath the plate 30 to become so high as to decrease the amount of foaming.

FIGS. 6 to 8 show another embodiment according to the present invention. A hole 301*a* receives the drive shaft 6 therethrough. The hole 301*a* includes a gap 301*b* and is made simply by a blanking operation. The oil cap 7 is set on the bottom end of the drive shaft 6, and is provided with an outwardly extending flange 32 at an upper end thereof. An upper surface of the flange 32 is parallel to a lower surface of the plate 30 with a clearance $\delta$. The radius of the flange 32 is larger than that of the hole 301*a* and its gas 301*b*.

When the flange 32 of the oil cap 7 rotates according to the rotation of the drive shaft 6, oil in the clearance $\delta$ is centrifugally driven to flow toward the outer periphery of the flange 32, so as to make the oil on the plate 30 to flow through the gap 301*b*. The centrifugal force produced in the oil in the clearance $\delta$ prevents the flow of oil from reversing from the basin 150 to the space above the plate 30. Four holes 33 shown in FIGS. 6 and 8 are formed by burring in a manner to narrow the radius of a projection as it extends in distance from a base portion 33*a* of the hole 33 to an extreme portion 33*b* of the projection.

The number of burred holes 33 is predetermined in consideration of the balance of the quantity of oil for pumping and returning. Each burred hole 33 is an auxiliary means for returning the oil to the basin 150 in the situation that the returned oil quantity through the hole 301*a* and the gap 301*b* is extremely large in comparison with that through the burred hole 33. A slender hole simply blanked can be used for each of the holes 33. FIG. 8 shows a bottom plan view of the plate 30 being perforated every 90°.

The flow preventing means has the function of allowing the oil to flow only in one direction and can be obtained by the structure of the element itself or a combination of elements, as shown in FIGS. 4 to 8. It is to be clearly understood that these structures were merely for purposes of illustration and that changes and modifications may readily be made therein by those skilled in the art without departing from the scope of this invention.

We claim:

1. A scroll-type positive fluid displacement apparatus comprising:

(a) a stationary scroll member (1) having a first spiral-shaped wrap, (b) an orbiting scroll member (2) having a second spiral-shaped wrap of the same shape as that of said first spiral wrap, said first and second wraps having rotated relative orientation, (c) a compression pocket (5) formed by a space between the wraps of said stationary scroll member and said orbiting scroll member, (d) a substantially vertically aligned drive shaft (6) having an eccentric hole formed at its upper end with a predetermined eccentricity, causing said orbiting scroll member to orbit, (e) a bearing (18) mounted in said hole for radially supporting said drive shaft, (f) a supporting member (8) (9) supporting said bearing, (g) a motor rotating said drive shaft, (h) a shell, a bottom portion of which is a basin (150), to pool an oil in which a lower end of said drive shaft is dipped, said shell containing said stationary and orbiting scroll members in its upper side and said motor in its lower side, (i) pumping means having a hole opening at said lower end of said drive shaft, said pumping means formed at least partially in the axial direction within said drive shaft and communicating to said bearing, to pump up the oil in said basin to said bearing by the rotation of said drive shaft, (j) a compartment plate (3) above said basin and below said motor having a center hole (300) to receive a lower end portion of said drive shaft below said motor therethrough at its center, said center hole providing a gap between said compartment plate and said drive shaft, said compartment plate collecting said oil in a pool at an upper face of said compartment plate, said gap allowing oil to flow from an upper side of said compartment plate to said basin, and (k) flow preventing means operatively associated with said plate for allowing flow of said oil in the direction from an upper side to a lower side of said plate and for inhibiting flow of said oil from said lower side to said upper side of said plate.

2. A scroll-type positive fluid displacement apparatus according to claim 1, wherein said flow preventing means comprises said center hole and an oil cap fixed on said drive shaft, said oil cap having an upper flange separated from the lower surface of said plate by a clearance for pumping the oil from the upper side to lower side of said plate through said gap of said center hole and through said clearance.

3. A scroll-type positive fluid displacement apparatus comprising:

(a) a stationary scroll member (1) having a first spiral-shaped wrap, (b) an orbiting scroll member (2) having a second spiral-shaped wrap of the same shape as that of said first spiral wrap, said first and second wraps having rotated relative orientation, (c) a compression pocket (5) formed by a space between the wraps of said stationary scroll member and said orbiting scroll member, (d) a substantially vertically aligned drive shaft (6) having an eccentric hole formed at its upper end with a predetermined eccentricity, causing said orbiting scroll member to orbit, (e) a bearing (18) mounted in said hole for radially supporting said drive shaft, (f) a supporting member (8) (9) supporting said bearing, (g) a motor rotating said drive shaft, (h) a shell, a bottom portion of which is a basin (150), to pool an oil in which a lower end of said drive shaft is dipped, said shell containing said stationary and orbiting scroll members in its upper side and said motor in its lower side, (i) pumping means having a hole opening at said lower end of said drive shaft, said pumping means formed at least partially in the axial direction within said drive shaft and communicating to said bearing, to pump up the oil in said basin to said bearing by the rotation of said drive shaft, (j) a compartment plate (3) having a center hole (300) to receive a lower end portion of said drive shaft therethrough at its center, said center hole providing a gap between said compartment plate and said drive shaft, and (k) flow preventing means operatively associated with said plate for allowing flow of said oil in the direction from an upper side to a lower side of said plate and for inhibiting flow of said oil from said lower side to said upper side of said plate;

wherein said flow preventing means comprises a first hole (30*c*) formed away from said center hole of said plate and a non-return valve (31) cooperating with said first hole.

4. A scroll-type positive fluid displacement apparatus comprising:

(a) a stationary scroll member (1) having a first spiral-shaped wrap, (b) an orbiting scroll member (2) having a second spiral-shaped wrap of the same shape as that of said first spiral wrap, said first and second wraps having rotated relative orientation, (c) a compression pocket (5) formed by a space between the wraps of said stationary scroll member and said orbiting scroll member, (d) a substantially vertically aligned drive shaft (6) having an eccentric hole formed at its upper end with a predetermined eccentricity, causing said orbiting scroll member to orbit, (e) a bearing (18) mounted in said hole for radially supporting said drive shaft, (f) a supporting member (8) (9) supporting siad bearing, (g) a motor rotating said drive shaft, (h) a shell, a bottom portion of which is a basin (150), to pool an oil in which a lower end of said drive shaft is dipped, said shell containing said stationary and orbiting scroll members in its upper side and said motor in its lower side, (i) pumping means having a hole opening at said lower end of said drive shaft, said pumping means formed at least partially in the axial direction within said drive shaft and communicating to said bearing, to pump up the oil in said basin to said bearing by the rotation of said drive shaft, (j) a compartment plate (3) having a center hole (300) to receive a lower end portion of said drive shaft therethrough at its center, said center hole providing a gap between said compartment plate and said drive shaft, and (k) flow preventing means operatively associated with said plate for allowing flow of said oil in the direction from an upper side to a lower side of said plate and for inhibiting flow of said oil from said lower side to said upper side of said plate;

wherein said flow preventing means comprises said center hole, said center hole being formed as a cylindrical hole structure extending downwardly from said plate, a radius of an extreme portion (300*b*) of said structure away from said plate being narrower than that of its base portion (300*a*) adjacent said plate.

* * * * *